US007905802B2

(12) United States Patent
Erhard

(10) Patent No.: US 7,905,802 B2
(45) Date of Patent: Mar. 15, 2011

(54) EXPANDING, EXPOSED-BLADE ARROW HEAD

(76) Inventor: Rory J. Erhard, Belgrade, MT (US)

( * ) Notice: Subject to any disclaimer, the term of this patent is extended or adjusted under 35 U.S.C. 154(b) by 551 days.

(21) Appl. No.: 11/974,614

(22) Filed: Oct. 13, 2007

(65) Prior Publication Data

US 2008/0102996 A1 May 1, 2008

Related U.S. Application Data

(60) Provisional application No. 60/856,076, filed on Nov. 1, 2006.

(51) Int. Cl.
*F42B 6/08* (2006.01)

(52) U.S. Cl. ..... 473/583

(58) Field of Classification Search ..... 473/583, 473/584

See application file for complete search history.

(56) References Cited

U.S. PATENT DOCUMENTS 2,859,970 A * 11/1958 Doonan ..... 473/583
2,993,697 A * 7/1961 Urban ..... 473/583
3,138,383 A * 6/1964 McKinzie ..... 473/583
4,099,720 A 7/1978 Zeren
4,973,060 A * 11/1990 Herzing ..... 473/583
5,090,709 A 2/1992 Johnson
5,100,143 A 3/1992 Puckett
5,112,063 A 5/1992 Puckett
5,172,916 A 12/1992 Puckett
5,322,297 A * 6/1994 Smith ..... 473/583
6,200,237 B1 3/2001 Barrie
6,270,435 B1 8/2001 Sodaro
6,290,903 B1 9/2001 Grace, Jr. et al.
6,322,464 B1 11/2001 Sestak
6,517,454 B2 2/2003 Barrie et al.
6,595,881 B1 7/2003 Grace, Jr. et al.
6,626,776 B2 9/2003 Barrie et al.
6,669,586 B2 12/2003 Barrie et al.
6,910,979 B2 6/2005 Barrie et al.
6,935,976 B1 8/2005 Grace, Jr. et al.
7,226,375 B1 6/2007 Sanford
7,234,220 B1 * 6/2007 Grace, Jr. ..... 29/428

OTHER PUBLICATIONS

Cabela's, Archery 2007, pp. 56, 58-63, Cabela's, Sidney, Nebraska.

* cited by examiner

*Primary Examiner* — John Ricci
(74) *Attorney, Agent, or Firm* — Robert M Hunter

(57) ABSTRACT

An expanding, exposed-blade arrow head and a method of its operation. In a preferred embodiment, the arrow head comprises: a ferrule comprising three blade holders and having a longitudinal cavity having a bottom; a tip comprising a piston that is slidably mounted in the longitudinal cavity, the tip having a front end having three slots; three blades, each of the blades having a forward end that is pivotably mounted in one of said slots and a body having a cutting edge, each body being slidably mounted in one of the blade holders; wherein the sliding of the piston in the longitudinal cavity toward the bottom causes the cutting edges to move outward.

24 Claims, 7 Drawing Sheets

EXPANDING, EXPOSED-BLADE ARROW HEAD

CROSS-REFERENCE TO RELATED APPLICATIONS

This application claims the benefit of U.S. Provisional Patent Application No. 60/856,076, filed Nov. 1, 2006, the disclosure of which patent application is incorporated by reference as if fully set forth herein.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

This invention relates to an arrow head commonly referred to as a broadhead. In particular, the invention relates to expanding, exposed-blade arrow heads.

Currently, there are two common types of broadheads on the market: fixed blade and mechanical. Both have their advantages and disadvantages.

Fixed blades have the cutting blades exposed and mounted so they maintain their position when passing through the target. This type of broadhead usually has a cutting diameter in the range from 0.875 to 1.500 inches. This cutting diameter is fixed, and does not change during flight. Most states have regulations that place a limit on the smallest cutting diameter a broadhead can have. These regulations commonly stipulate a minimum cutting diameter of 0.875 inch.

Mechanical broadheads have cutting blades that are initially folded in or retracted. Upon impact with the target, the blades expand to a given cutting diameter. Most mechanical broadheads open in a rotational fashion. They usually have a tab or protrusion on the leading edge of the arrow head that catches the flesh of the target which folds the blade open, rotating the blade around a fixed pivot point near the following portion of the broadhead. This action consumes vital kinetic energy, forcing the blades in a counter productive direction until the blades rotate over center. Also, the blades are supported (connected to the central portion of the arrow head) at only one point, the pivot point, rendering them easily bent.

Mechanical broadheads usually have a cutting diameter after full expansion that ranges from one inch to three inches. The hunting regulations of some states prohibit the use of mechanical broadheads because they may not open correctly and ensure a humane kill.

Each of the aforementioned broadhead types typically has a leading tip consisting of mild steel, or an inset piece of razor blade. These two types of tip usually work well when they hit flesh. When they hit a heavy bone, however, they bend, fold, or dull.

Common problems associated with these two types of background art broadheads have consumer sentiment split about which type works best. Fixed blade arrow heads are favored for the security of having the cutting blades exposed and fixed in position. Conversely, fixed blades are usually considered less accurate because the exposed blades are influenced by the air as it passes through them, causing the arrow to hit a different spot than the archer's field point. This requires that archers sight in differently with fixed broadheads.

Mechanical broadheads have a lower aerodynamic co-efficient, making the influence of air pressure during flight less. This allows a mechanical broadhead to hit the same desired location as the archer's field point. Moreover, the probability that a mechanical broadhead will not open at all or will not open to full cutting diameter is low. A significant proportion of consumers prefer the larger cutting diameter of mechanical broadheads. One of the problems with these large-cutting-diameter mechanical broadheads is that the action of the blades folding open consumes a large percentage of the initial energy of the arrow. This may rob enough kinetic energy from the arrow to prevent a humane kill. Another limitation is the need to hold the blades in the retracted position with a band, e.g., a rubber band, that must be replaced between uses.

The background art is characterized by U.S. Pat. Nos. 5,090,709; 5,100,143; 5,112,063; 5,172,916; 6,200,237; 6,270,435; 6,290,903; 6,322,464; 6,517,454; 6,595,881; 6,626,776; 6,669,586; 6,910,979; 6,935,976 and 7,226,375; the disclosures of which patents are incorporated by reference as if fully set forth herein.

None of the background art references disclose a mechanical broadhead that supports the forward end of each of its blades pivotably and the body of each of its blades laterally, thereby providing two points of support for each blade. Moreover, none of the background art references disclose a mechanical broadhead that comprises a plunger to which each of its blades is pivotably attached that is longitudinally movable relative to a ferrule having blade holders to which each of its blades is slidably attached, thereby securing said plunger to said ferrule. Also, none of the background art references disclose a mechanical broadhead that relies on a longitudinally compressible or expandable spring or a shearable or crushable structure to maintain its blades in a retracted position during flight.

BRIEF SUMMARY OF THE INVENTION

The purpose of the invention is to provide an expandable arrow head that incorporates the best features of both types of broadheads into one product. To the archer, the invention provides the security of having exposed blades with the desired larger cutting diameter of mechanical broadheads. In flight, the blades have a low profile, so there is a much lower probability that aerodynamics will affect the flight path. Upon impact, the blades expand laterally, thereby increasing the cutting diameter of the arrow head. Moreover, penetrating kinetic energy is not decreased when the blades expand.

The invention comprises a ferrule, a tip and a plurality of cutting blades. The tip is preferably made from a material that is harder than the material from which the ferrule is fabricated. Preferred embodiments of the invention incorporate a bone-splitting tungsten carbide tip that incorporates hinge points for the blades. Tungsten carbide is known to be hard enough to cut steel and etch glass, and is used in industrial applications when a hard tough material is needed. For this reason, the hard tip of preferred embodiments of the broadhead does not bend or flex when it hits bone. Instead, the hard tip splits bone and allows the blades to pass through the target easier. The blades are preferably hinged at their front ends and their rear ends rest against a solid forcing cone. In a preferred embodiment, a spring that is preferably encapsulated between the tip and the ferrule keeps the blades folded in their lowest profile during flight. The ferrule preferably has a threaded end that is used to attach the broadhead to an arrow.

When the arrow hits its target, the force that the target applies to the tip of the arrow head causes the kinetic energy of the moving arrow to push the forcing cone forward relative to the tip. As the forcing cone moves forward, the angled surface of the forcing cone forces the rear ends of the blades to expand laterally, increasing the cutting diameter of the broadhead. Upon impact, the target's resistance force pushing backward on the tip is greater than the compression force of the spring, which maintains the larger cutting diameter while the broadhead passes through the target. The increased cutting diameter gives the hunter a quicker, humane kill. In an alternative embodiment, an expansion spring is used and bottom end of the tip expands the spring as the tip moves into the ferrule cavity.

In another preferred embodiment, a shear pin and not a spring prevents the rearward movement of the tip and expansion of the blades during flight. When the tip hits the target, a piston that is forms the rear end of the tip cuts the shear pin, allowing the blades to expand. In this embodiment, a spring is not required. Any shearable structure may be substituted for the shear pin. Alternatively, a crushable structure that is situated in the ferrule cavity may also be relied upon.

In yet another preferred embodiment, each of the blades is provided with a plurality of adjustment holes to allow for fixing the diameter of the expanded broadhead before it is used. In this embodiment, a spring is not required because movement of the tip relative to the ferule does not occur.

In a preferred embodiment, the invention is an expanding, exposed-blade arrow head comprising: a ferrule comprising a plurality (preferably three) blade holders on its outer surface, each of said blade holders having a longitudinal channel, each of said longitudinal channels having a camming surface, said ferrule having a longitudinal cavity therein, said longitudinal cavity having a bottom end and a top end; a spring that is mounted in the bottom end of said longitudinal cavity; a tip having a piston that is slidably mounted in the top end of said longitudinal cavity, said tip having a plurality of tip grooves; a plurality of blades, each of said blades comprising a blade forward end, a blade body having a blade slot and a blade cutting edge, each of said blade forward ends being pivotably mounted in one of said tip grooves, and each of said blade bodies being slidably mounted in one of said longitudinal channels; a plurality of first fasteners, each first fastener securing one of the blade forward ends in one of said tip grooves; and a plurality of second fasteners, each second fastener securing one of said blade bodies in one of said longitudinal channels; wherein said tip is operative to move downward in said longitudinal cavity when said arrow head hits a target, said downward movement causing each of said blade cutting edges to move outward. Preferably, said spring is a compression spring. Preferably, the arrow head further comprises: three blade holders and three blades. Preferably, each of said blades has a slot having a first end and a second end and each of said blade holders comprises a screw or pin that is slidable in each of said slots from a first position in which said blades are in a retracted position to a second position in which said blades are in an expanded position.

In another preferred embodiment, the invention is an arrow head comprising: a ferrule comprising three blade holders and having a longitudinal cavity having a bottom; a tip comprising a piston that is slidably mounted in said longitudinal cavity, said tip having a front end having three slots; three blades, each of said blades having a forward end that is pivotably mounted in one of said slots and a body having a cutting edge, each said body being slidably mounted in one of said blade holders; wherein the sliding of said piston in said longitudinal cavity toward said bottom causes said cutting edges to move outward. Preferably, the arrow head further comprises a compression spring that is disposed in said longitudinal cavity and that urges said piston away from said bottom and said cutting edges inward.

In yet another embodiment, the invention is an arrow head comprising: a ferrule comprising a plurality of blade holders, said ferrule having a longitudinal cavity having a bottom; a tip comprising a piston that is moveably mounted in said longitudinal cavity, said tip having a front end having a plurality of slots; a plurality of blades, each of said blades having a forward end that is pivotably mounted in one of said slots and a body having a cutting edge, each said body being slidably mounted in one of said blade holders; and means for resisting the movement of said piston in said longitudinal cavity toward said bottom; wherein the movement of said piston in said longitudinal cavity toward said bottom is operative to cause each cutting edge to move outward.

In a further embodiment, the invention is an apparatus comprising: a plurality of means for cutting having a cutting diameter; means for slidably supporting each of said plurality of means for cutting on a caming surface, said means for slidably supporting comprising a forward end and having a longitudinal cavity; and means for pivotably supporting each of said plurality of means for cutting, said means for pivotably supporting having a rear end and being slidably mounted in a first portion of said longitudinal cavity; wherein said means for pivotably supporting forces said means for cutting against said camming surface when said means for pivotably supporting slides into said cavity, thereby causing said cutting diameter to increase. Preferably, each means for cutting has a slot and said means for slidably supporting has a screw or pin that is slidable in each slot. Preferably, said said means for pivotably supporting is releasably attached to said means for slidably supporting by a shearable body. Preferably, the apparatus further comprises: a spring that is disposed in a second portion of said longitudinal cavity that urges said rear end toward said forward end. Preferably each of said means for cutting has a plurality of adjustment holes and said means for slidably supporting has a screw or pin that is insertable into each said adjustment hole.

In yet another preferred embodiment, the invention is a mechanical broadhead comprising: a plurality of blades, each of said blades having a forward end and a body; first means for supporting, first means for supporting providing support for the forward end of each of said blades pivotably (e.g., a tip); and second means for supporting providing support for the body of each of said blades laterally (e.g., a ferrule); thereby providing two points of support for each of said blades. Preferably, each body is provided with a plurality of adjustment holes and each body is fixed to said second means for supporting by a fastener. Alternatively, in another preferred embodiment, the invention is a mechanical broadhead that comprises: a plurality of blades; a ferrule having blade holders to which each of said blades is slidably attached; a plunger to which each of said blades is pivotably attached that is longitudinally movable relative to said ferrule to which each of said blades is attached; thereby securing said plunger to said ferrule. Alternatively, in another preferred embodiment, the invention is a mechanical broadhead comprising: a plurality of blades; and a ferrule having a longitudinal cavity in which is situated a longitudinally compressible spring, a longitudinal expandable spring, a shearable structure, a crushable structure or a compressible structure; wherein longitudinally compressible spring, said longitudinal expandable spring, said shearable structure, said crushable structure or said compressible structure is operative to maintain said blades in a retracted position during flight.

In another preferred embodiment, the invention is a method of operating a broadhead comprising: attaching a broadhead disclosed herein to an arrow and shooting said arrow at a target; until said broadhead hits said target, said spring urging said tip forward thereby maintaining said blades in said retracted position; when said tip hits said target, said target applying a backward force to said tip, said backward force causing said piston to slide backward in said longitudinal cavity, said sliding action causing said blades to slide against said camming surfaces and rotate relative to said first fasteners into said expanded position.

In another embodiment, the invention is an arrow comprising an arrow head disclosed herein. In another embodiment, the invention is a hunting apparatus comprising: a bow; and an arrow disclosed herein.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
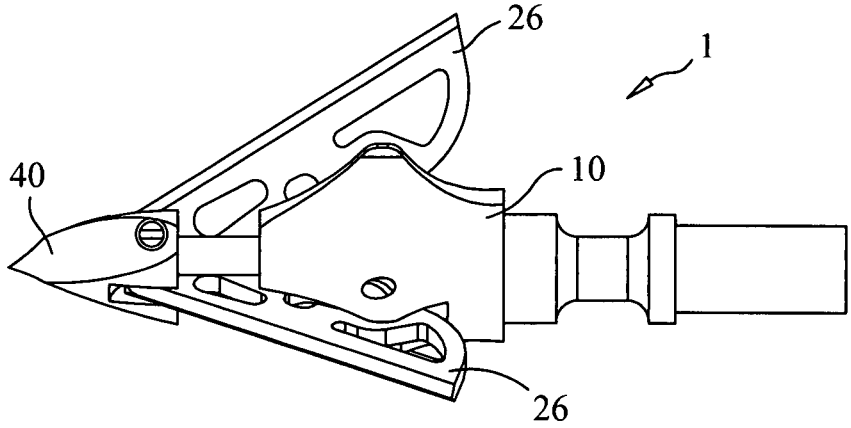
FIG. 1 is a side elevation view of a preferred embodiment of the invention. In this view, the cutting blades are at their smallest diameter.

The following reference numerals are used to indicate the parts and environment of the invention on the drawings:

1 expanding, exposed-blade broadhead, broadhead, arrow head
3 arrow
5 bow
10 ferrule
12 spring cavity, longitudinal cavity, cavity
14 cam surface
15 threads
16 screw or pin
18 ferrule grooves, longitudinal channels
19 blade holders
20 ferrule surface
26 cutting blades, blades
28 outer surface, blade cutting edge, cutting edge
30 hole
34 first edge
36 second edge
38 slot
40 conical or trocar-shaped tip, tip
42 pivot
44 tip surface
45 piston
46 tip grooves
47 tip vertices
48 tip surface
60 compression spring, spring
70 shear pin
72 adjustment holes

DETAILED DESCRIPTION OF THE INVENTION

Referring to FIGS. 1-17, a preferred embodiment the present invention is illustrated in the form of expanding, exposed-blade broadhead 1. Broadhead 1 preferably comprises ferrule 10 and a plurality of cutting blades 26 that are pivotally coupled to tip 40. In use, broadhead 1 is preferably attached to arrow 3.

Figure 2:
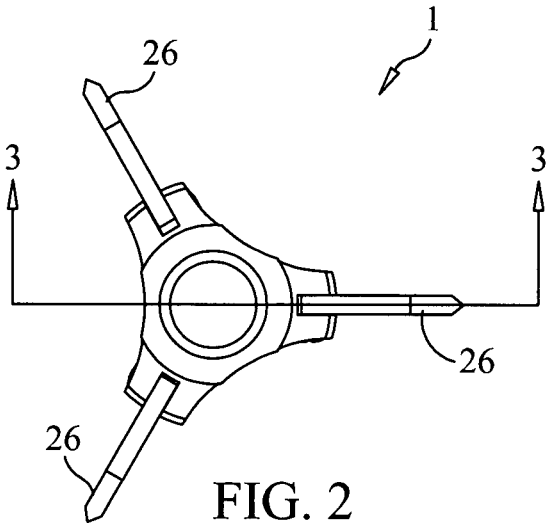
FIG. 2 is a frontal elevation view of a preferred embodiment of the invention. In this view, the cutting blades are at their smallest diameter.
Figure 3:
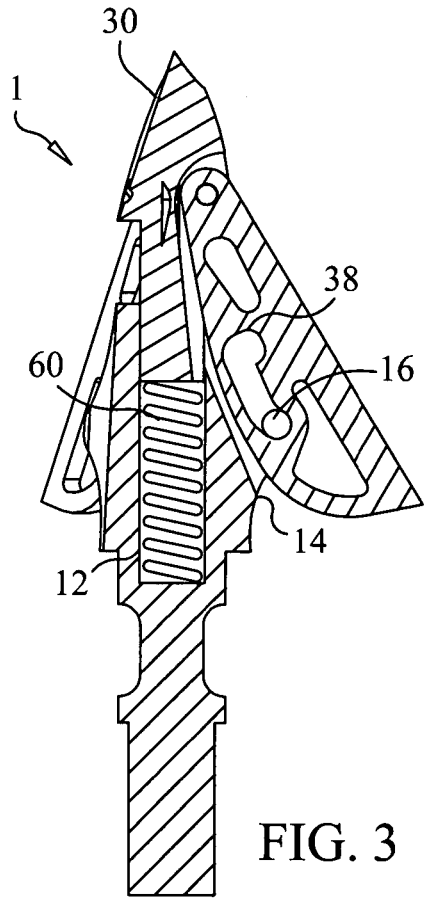
FIG. 3 is a cross sectional view of a preferred embodiment of the invention. In this view, the cutting blades are at their smallest diameter.

Referring to FIGS. 1-3, broadhead 1 is shown in the retracted (initial) position with cutting blades 26 disposed at their smallest cutting diameter. In this position, piston 45 effectively does not compress spring 60 in cavity 12 and screw or pin 16 is disposed at the bottom of slot 38.

Figure 4:
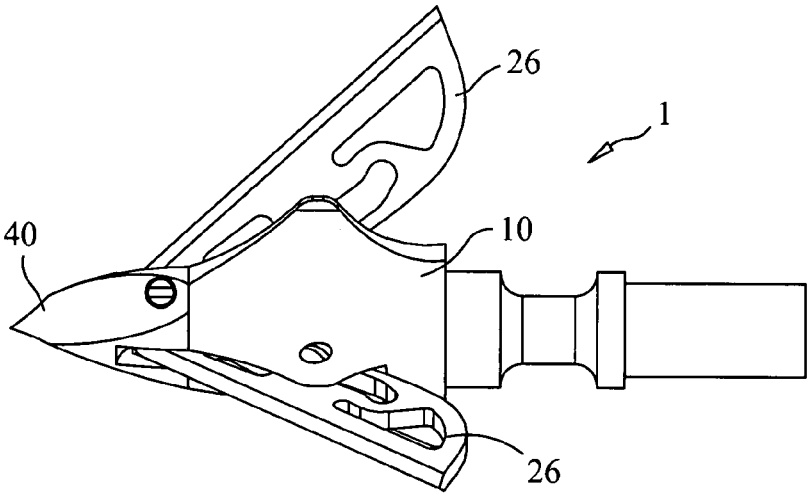
FIG. 4 is a side elevation view of a preferred embodiment of the invention. In this view, the cutting blades are at their largest diameter.
Figure 5:
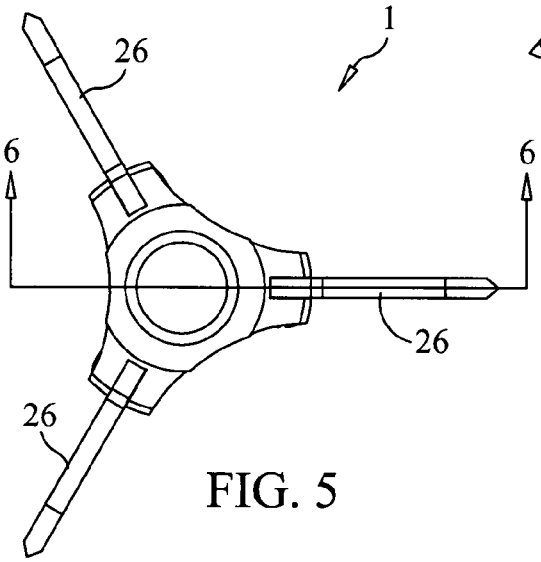
FIG. 5 is a frontal elevation view of a preferred embodiment of the invention. In this view, the cutting blades are at their largest diameter.
Figure 6:
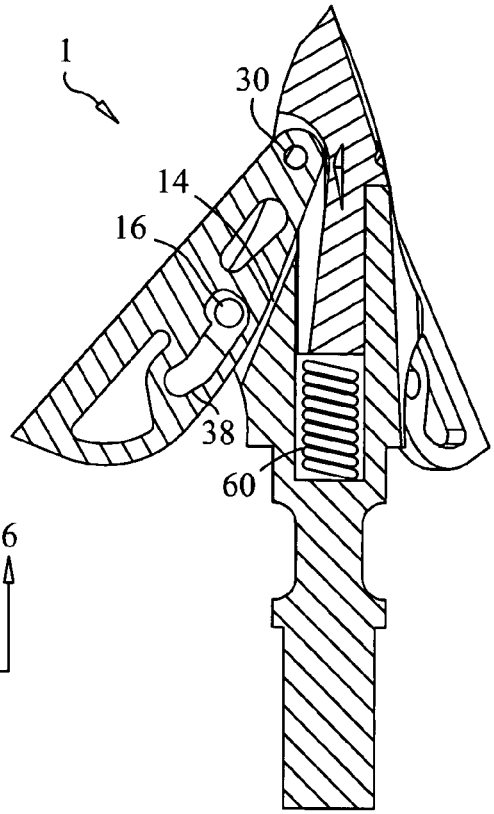
FIG. 6 is a cross sectional view of a preferred embodiment of the invention. In this view, the cutting blades are at their largest diameter.
Figure 7:
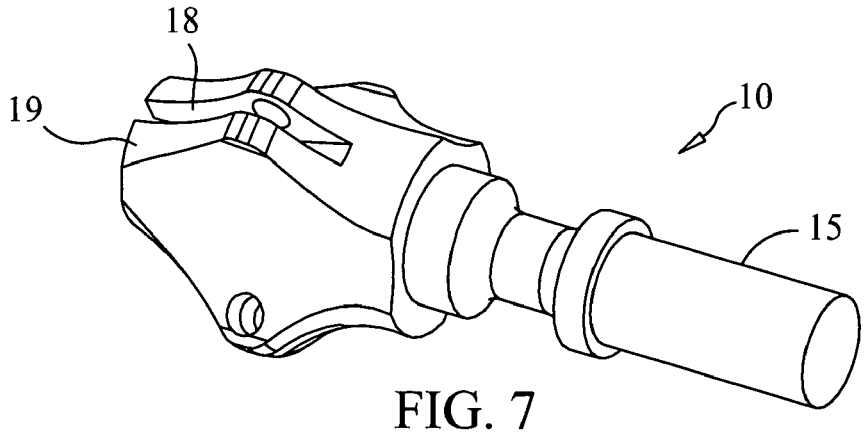
FIG. 7 is a perspective view of the ferrule of a preferred embodiment of the invention.
Figure 8:
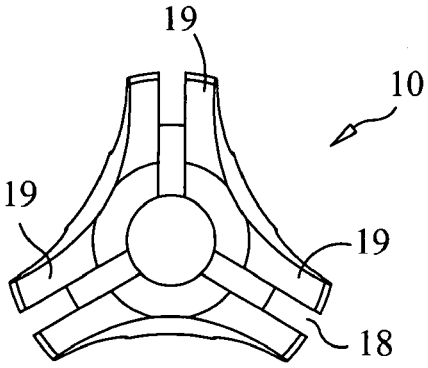
FIG. 8 is a frontal elevation view of the ferrule of a preferred embodiment of the invention.
Figure 9:
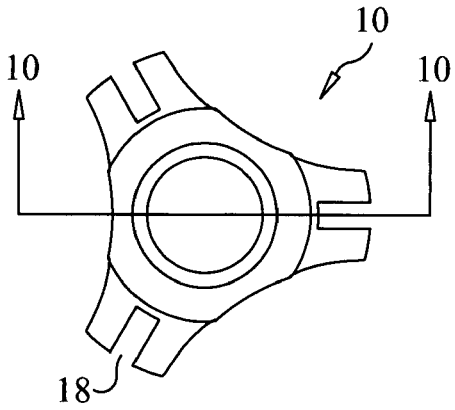
FIG. 9 is a bottom elevation view of the ferrule of a preferred embodiment of the invention.
Figure 10:
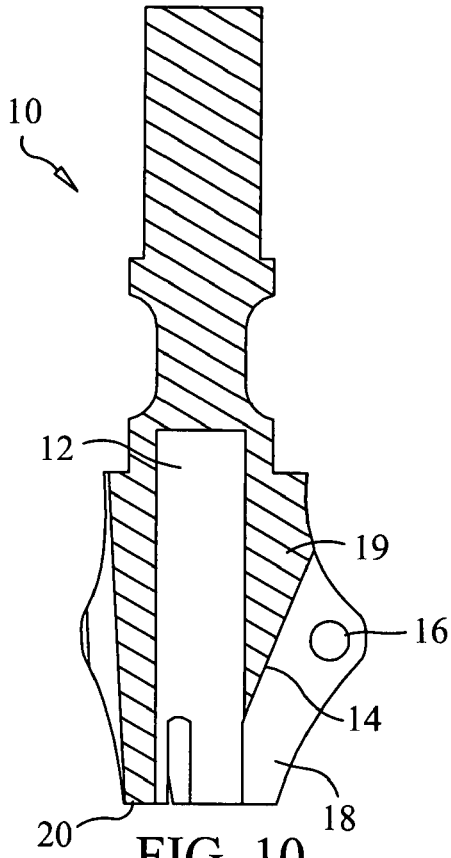
FIG. 10 is a cross sectional view of the ferrule of a preferred embodiment of the invention.
Figure 11:
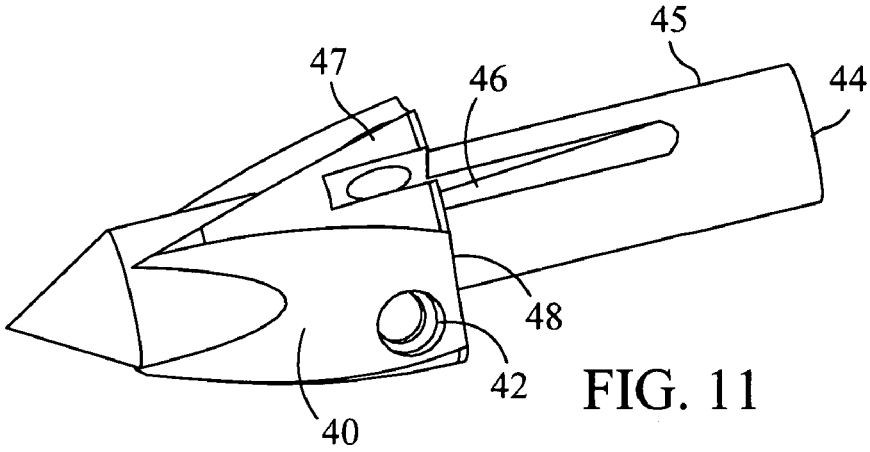
FIG. 11 is a perspective view of the tip of a preferred embodiment of the invention.
Figure 12:
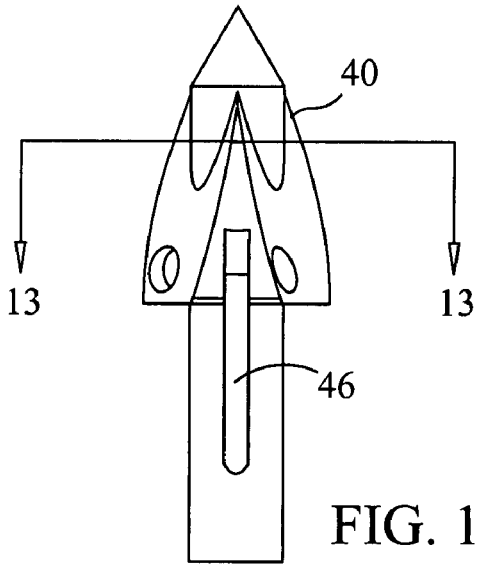
FIG. 12 is a side elevation view of the tip of a preferred embodiment of the invention.

Referring to FIGS. 4-6, broadhead 1 is shown in the extended (final) position with cutting blades 26 disposed at their largest cutting diameter. In this position, piston 45 compresses spring 60 in cavity 12 and screw or pin 16 is disposed at the top of slot 38.

Referring to FIGS. 7-10, ferrule 10 is shown to preferably have a single spring cavity 12 and a plurality of blade holders 19, each of which has a single ferrule groove 18. A screw or pin 16 preferably traverses each of the ferrule grooves 18 and by interacting with slots 38 holds blades 26 in their retracted position when spring 60 is compressed. Surfaces 14 lie substantially on a surface of a hypothetical cone and together comprise a forcing cone or camming surface. Threads 15 that are preferably provided on the outer surface of the rear end of ferrule 10 are used to attach broadhead 1 to an arrow (not shown).

Figure 13:
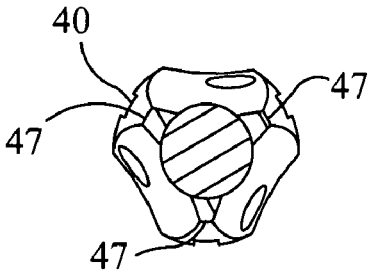
FIG. 13 is a cross sectional view of the tip of a preferred embodiment of the invention.
Figure 14:
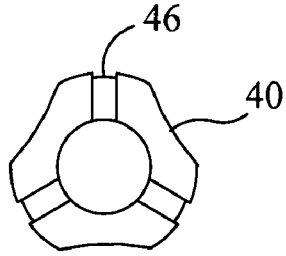
FIG. 14 is a bottom elevation view of the tip of a preferred embodiment of the invention.

Referring to FIGS. 11-14, tip 40 may be fabricated from tungsten carbide. Alternatively, tip 40 may comprise an inset piece of hardened material at its forward end. Tip 40 is preferably substantially conical or trocar shaped having an approximate triangular cross section as best seen in FIG. 13. Each of the tip vertices 47 of tip 40 preferably receives the forward end of a single cutting blade 26 which rests in a single tip groove 46 when the blades 26 are in the retracted position. Ferrule 10 preferably further has corresponding ferrule grooves 18 that except blades 26.

Figure 15:
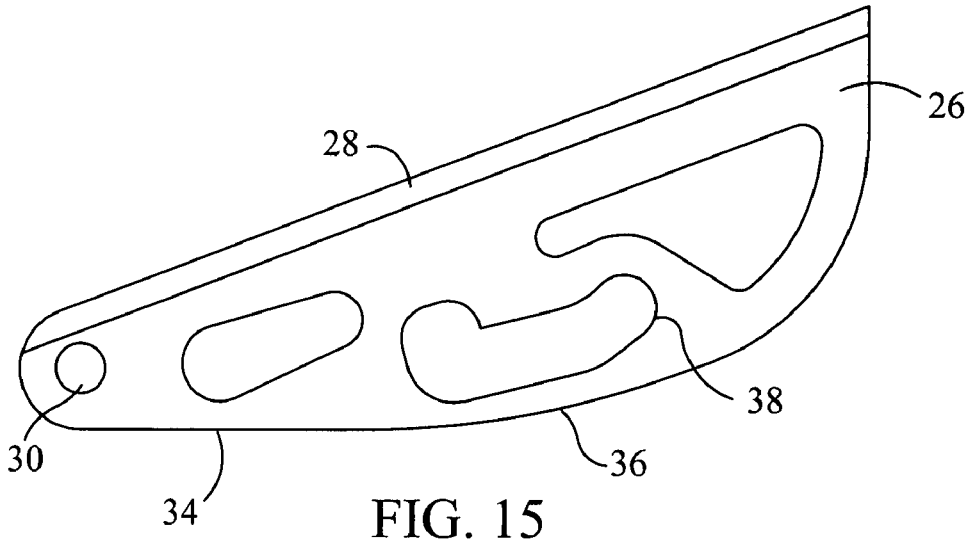
FIG. 15 is a side elevation view of one of the cutting blades of a preferred embodiment of the invention.
Figure 16:
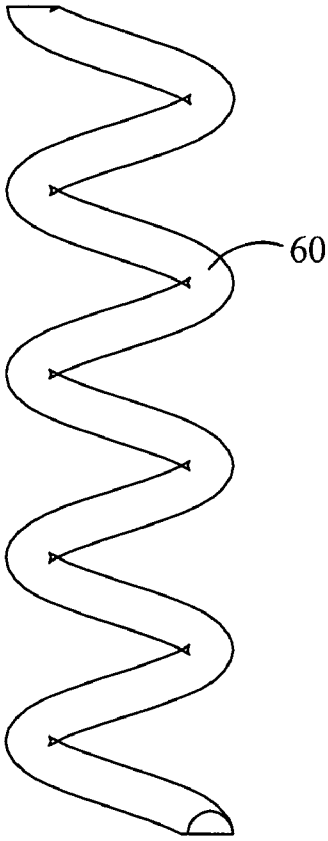
FIG. 16 is a side elevation view of the spring of a preferred embodiment of the invention.

Referring to FIG. 15, the edges of underside of each blade 26 are angled relative to cutting edge 28 at two angles. First edge 34 is disposed at a first angle and second edge 36 is disposed at a second angle. Each second edge 36 sits flush against a cam surface 14 of ferrule 10 when blades 26 are in the retracted position.

Each cutting blade 26 preferably has a hole 30 in the forward portion of the blade. Pivot 42 couples the forward end of each cutting blade 26 to tip 40, thereby providing a first means of support for each blade 26. In a preferred embodiment, each pivot 42 is a screw that screws into each tip vertex 47, although other fastening means are also envisioned. Each cutting blade 26 sits in one of the ferrule grooves 18 of ferrule 10. A screw or pin 16 that extends across each of the ferrule grooves 18 is disposed in slot 38 of each blade 26, thereby providing a second means of support for each blade 26.

Figure 17:
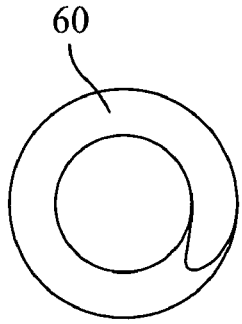
FIG. 17 is a top plan view of the spring of a preferred embodiment of the invention.

Referring to FIG. 17, in a preferred embodiment, compression spring 60 is encapsulated in cavity 12 of ferrule 10. Spring 60 pushes against surface 44 of piston 45 portion of tip 40 to maintain cutting blades 26 in the retracted position.

Upon impact with the target, the force exerted by the target on tip 40 causes piston 45 to slide back into spring cavity 12, compressing spring 60. During this movement, each surface 14 exerts a camming, outward force on second edge 36 of each blade 26 as each screw or pin 16 slides in slot 38 of each blade 26. As tip 40 changes position, the blades 26 continue to slide backward and eventually surface 14 exerts a camming, outward force on first edge 34 of each blade 26 as screw or pin 16 continues to slide in slot 38 of each blade 26. Thus, each blade 26 pivots around pivot 42 as tip 40 moves backward.

In this embodiment, when blades 26 are extended fully, tip surface 48 is mated against ferrule surface 20, cam surface 14 is mated against first edge 34 and piston 45 has fully compressed spring 60. This action cause blades 26 to have a larger outside diameter than they do in the retracted position. To maintain this position, the force exerted upon outer surface 28 of each blade 26 and friction between first edge 34 and cam surface 14 are coupled with the force exerted by the target on tip 40 overcomes the force exerted by compression spring 60 while broadhead 1 passes through the target.

Figure 18:
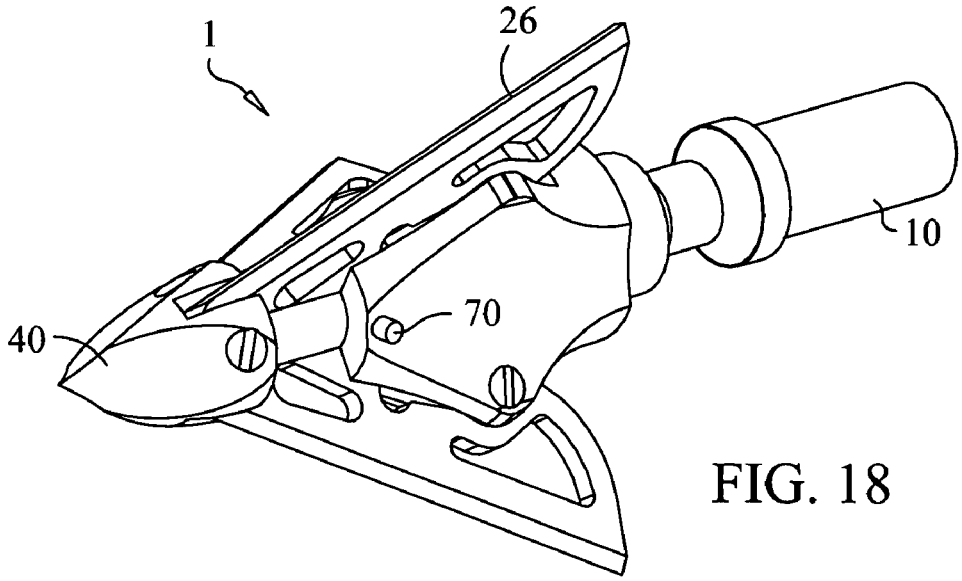
FIG. 18 is a side elevation view of another preferred embodiment of the invention.

Referring to FIG. 18, another preferred embodiment of broadhead 1 is illustrated. In this embodiment, broadhead 1 is maintained in the retracted position by a shearable body (e.g., shear pin 70 that extends from ferrule 10 into piston 45). When broadhead 1 strikes its target, the force exerted by the target on tip 40 shears shear pin 70 and allows piston 45 to move backward into cavity 12. This movement causes blades 26 to extend to their largest diameter. This embodiment preferably does not include spring 60. In an alternative embodiment, cavity 12 contains a (preferably replacable) crushable structure or a compressible structure, e.g., a plastic foam (not shown).

Figure 19:
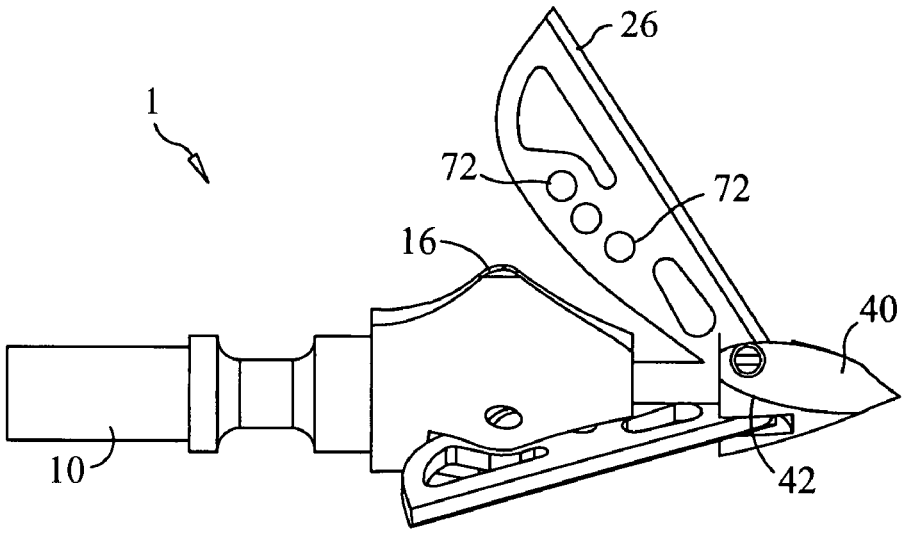
FIG. 19 is a side elevation view of yet another preferred embodiment of the invention.

Referring to FIG. 19, yet another preferred embodiment of broadhead 1 is illustrated. In this embodiment, each of the blades 26 is held in a fixed position by passing one of the screws 16 through one of the (preferably three) adjustment holes 72 in each blade 26. Ferrule grooves 18 support the blades 26 laterally as in the other embodiments. This embodiment preferably does not include spring 60. It is operated by loosening fasteners (e.g., screws 16) and moving tip 40 in or out to position blades 26 at the desired cutting diameter and then re-installing screws 16.

Figure 20:
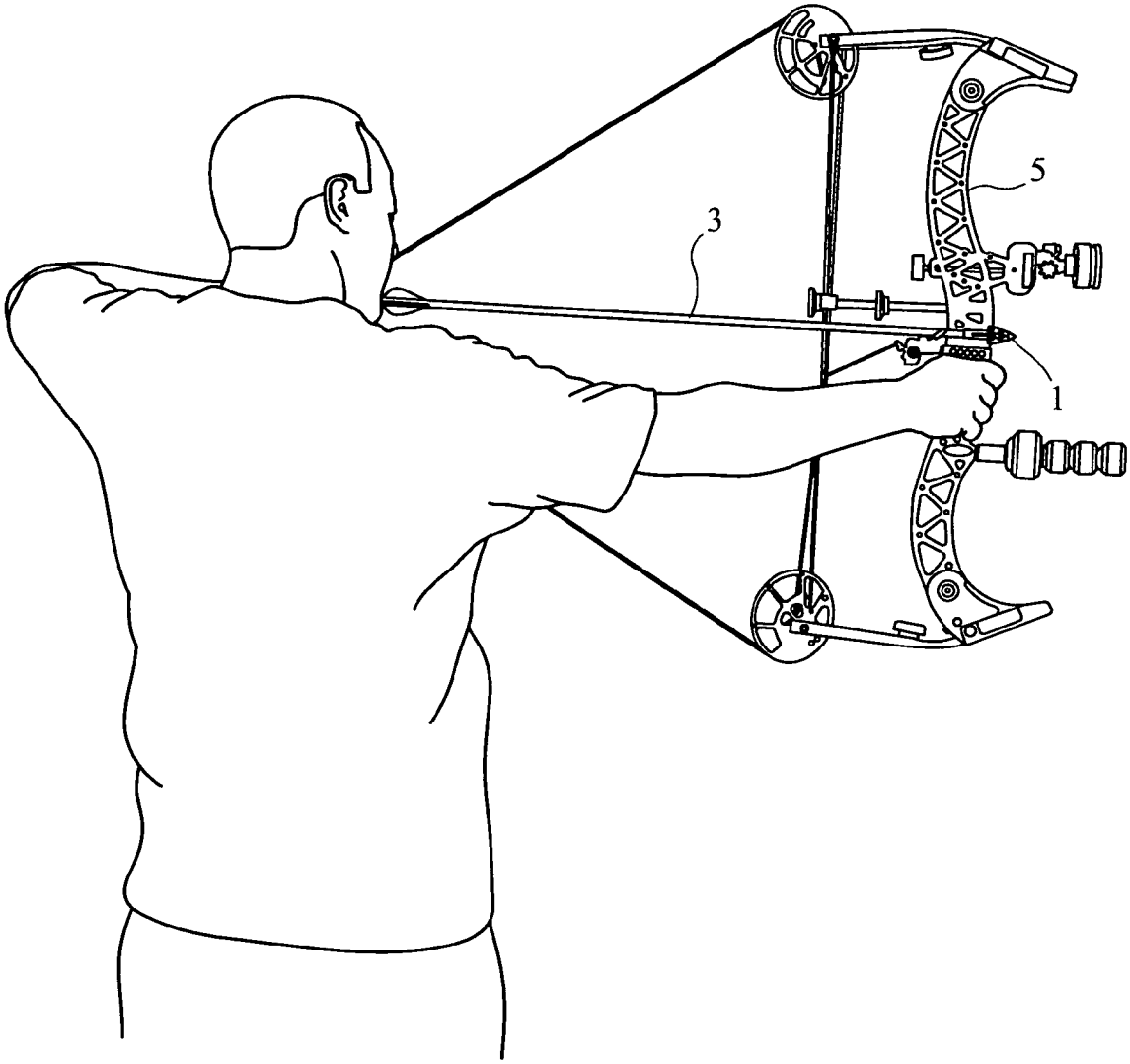
FIG. 20 is a side elevation view of an archer shooting a bow and arrow to which is attached a broadhead in accordance with a preferred embodiment of the invention.

Referring to FIG. 20, a hunting apparatus is illustrated that comprises bow 5 and arrow 3. Preferably, arrow 3 comprises broadhead 1.

Many variations of the invention will occur to those skilled in the art. Some variations include cutting blades that move outward when the broadhead strikes the target. Other variations call for blades having a fixed cutting diameter. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. An expanding, exposed-blade arrow head comprising:

a ferrule comprising a plurality of blade holders on its outer surface, each of said blade holders having a longitudinal channel, each of said longitudinal channels having a camming surface, said ferrule having a longitudinal cavity therein, said longitudinal cavity having a bottom end and a top end;

a spring that is mounted in the bottom end of said longitudinal cavity;

a tip having a piston that is slidably mounted in the top end of said longitudinal cavity, said tip having a plurality of tip grooves;

a plurality of blades, each of said blades comprising a blade forward end, a blade body having a blade slot and a blade cutting edge, each of said blade forward ends being pivotably mounted in one of said tip grooves, and each of said blade bodies being slidably mounted in one of said longitudinal channels;

a plurality of first fasteners, each first fastener securing one of the blade forward ends in one of said tip grooves; and a plurality of second fasteners, each second fastener securing one of said blade bodies in one of said longitudinal channels;

wherein said tip is operative to move downward in said longitudinal cavity when said arrow head hits a target, said downward movement causing each of said blade cutting edges to move outward.

2. The expanding, exposed-blade arrow head of claim 1 wherein said spring is a compression spring.

3. The expanding, exposed-blade arrow head of claim 1 further comprising:

three blade holders and three blades.

4. The expanding, exposed-blade arrow head of claim 1 wherein each of said blades has a slot having a first end and a second end and each of said second fasteners comprises a screw or pin that is slidable in each of said slots from a first position in which said blades are in a retracted position to a second position in which said blades are in an expanded position.

5. A method of operating a broadhead comprising:

attaching the broadhead of claim 1 to an arrow and shooting said arrow at a target;

until said broadhead hits said target, said spring urging said tip forward thereby maintaining said blades in said retracted position;

when said tip hits said target, said target applying a backward force to said tip, said backward force causing said piston to slide backward in said longitudinal cavity, said sliding action causing said blades to slide against said camming surfaces and rotate relative to said first fasteners into said expanded position.

6. An arrow comprising the arrow head of claim 1.

7. A hunting apparatus comprising:

a bow; and the arrow of claim 1.

8. An arrow head comprising:

a ferrule comprising three blade holders and having a longitudinal cavity having a bottom;

a tip comprising a piston that is slidably mounted in said longitudinal cavity, said tip having a front end having three slots;

three blades, each of said blades having a forward end that is pivotably mounted in one of said slots and a body having a cutting edge, each said body being slidably mounted in one of said blade holders;

wherein the sliding of said piston in said longitudinal cavity toward said bottom causes said cutting edges to move outward.

9. The arrow head of claim 8 further comprising:

a compression spring that is disposed in said longitudinal cavity and that urges said piston away from said bottom and said cutting edges inward.

10. An arrow head comprising:

a ferrule comprising a plurality of blade holders, said ferrule having a longitudinal cavity having a bottom;

a tip comprising a piston that is moveably mounted in said longitudinal cavity, said tip having a front end having a plurality of slots;

a plurality of blades, each of said blades having a forward end that is pivotably mounted in one of said slots and a body having a cutting edge, each said body being slidably mounted in one of said blade holders; and means for resisting the movement of said piston in said longitudinal cavity toward said bottom;

wherein the movement of said piston in said longitudinal cavity toward said bottom is operative to cause each cutting edge to move outward.

11. An apparatus comprising:

a plurality of means for cutting having a cutting diameter;

means for sidably supporting each of said plurality of means for cutting on a camming surface, said means for slidably supporting comprising a forward end and having a longitudinal cavity having a bottom;

means for pivotably supporting each of said plurality of means for cutting, said means for pivotably supporting having a rear end and being slidably mounted in a first portion of said longitudinal cavity; and means for resisting the movement of said rear end in said longitudinal cavity toward said bottom, said means for resisting being disposed between said means for pivotably supporting and said bottom;

wherein said means for pivotably supporting forces said means for cutting against said camming surface when said means for pivotably supporting slides into said cavity, thereby causing said cutting diameter to increase.

12. The apparatus of claim 11 wherein each means for cutting has a slot and said means for slidably supporting has a screw or pin that is slidable in each slot.

13. The apparatus of claim 11 wherein said means for pivotably supporting is releasably attached to said means for slidably supporting by a shearable body.

14. The apparatus of claim 11 wherein said means for resisting comprises:

a spring that is disposed in a second portion of said longitudinal cavity that urges said rear end toward said forward end.

15. The apparatus of claim 11 wherein each of said means for cutting has a plurality of adjustment holes and said means for slidably supporting has a screw or pin that is insertable into one of said plurality of adjustment holes in each of said means for cutting.

16. A mechanical broadhead comprising:

a plurality of blades, each of said blades having a forward end and a body;

first means for supporting, said first means for supporting comprising a piston and providing support for the forward end of each of said blades pivotably;

second means for supporting, said second means for supporting having a cavity for accepting said piston and said second means for supporting providing support for the body of each of said blades laterally; and means for fastening each of said blades to said second means for supporting;

thereby providing two points of support for each of said blades.

17. The mechanical broadhead of claim 16 wherein said means for fastening comprises a fastener and wherein each body is provided with a plurality of adjustment holes and each body is fixed to said second means for supporting by said fastener.

18. A mechanical broadhead that comprises:

a plurality of blades;

a ferrule having blade holders in each of which one of said blades is slidably movable;

a plunger to which each of said blades is pivotably attached that is longitudinally movable relative to said ferrule; and a fastener that attaches each of said blades to said ferrule;

thereby securing said plunger to said ferrule.

19. A mechanical broadhead comprising:

a plurality of blades; and a ferrule having a longitudinal cavity in which is situated a longitudinally compressible spring, a longitudinal expandable spring, a shearable structure or a crushable structure;

wherein said longitudinally compressible spring, said longitudinal expandable spring, said shearable structure or said crushable structure is operative to maintain said blades in a retracted position during flight.

20. An apparatus comprising:

a plurality of means for cutting having a cutting diameter;

means for sidably supporting each of said plurality of means for cutting on a camming surface, said means for slidably supporting comprising a forward end and having a longitudinal cavity; and means for pivotably supporting each of said plurality of means for cutting, said means for pivotably supporting having a rear end and being slidably mounted in a first portion of said longitudinal cavity;

wherein said means for pivotably supporting forces said means for cutting against said camming surface when said means for pivotably supporting slides into said cavity, thereby causing said cutting diameter to increase; and wherein each means for cutting has a slot and said means for slidably supporting has a screw or pin that is slidable in each slot.

21. An apparatus comprising:

a plurality of means for cutting having a cutting diameter;

means for sidably supporting each of said plurality of means for cutting on a camming surface, said means for slidably supporting comprising a forward end and having a longitudinal cavity; and means for pivotably supporting each of said plurality of means for cutting, said means for pivotably supporting having a rear end and being slidably mounted in a first portion of said longitudinal cavity;

wherein said means for pivotably supporting forces said means for cutting against said camming surface when said means for pivotably supporting slides into said longitudinal cavity, thereby causing said cutting diameter to increase; and wherein said means for pivotably supporting is releasably attached to said means for slidably supporting by a shearable body.

22. An apparatus comprising:

a plurality of means for cutting having a cutting diameter;

means for sidably supporting each of said plurality of means for cutting on a camming surface, said means for slidably supporting comprising a forward end and having a longitudinal cavity;

means for pivotably supporting each of said plurality of means for cutting, said means for pivotably supporting having a rear end and being slidably mounted in a first portion of said longitudinal cavity; and a spring that is disposed in a second portion of said longitudinal cavity that urges said rear end toward said forward end;

wherein said means for pivotably supporting forces said means for cutting against said camming surface when said means for pivotably supporting slides into said cavity, thereby causing said cutting diameter to increase.

23. An apparatus comprising:

a plurality of means for cutting having a cutting diameter;

means for sidably supporting each of said plurality of means for cutting on a camming surface, said means for slidably supporting comprising a forward end and having a longitudinal cavity; and means for pivotably supporting each of said plurality of means for cutting, said means for pivotably supporting having a rear end and being slidably mounted in a first portion of said longitudinal cavity;

wherein said means for pivotably supporting forces said means for cutting against ,said camming surface when said means for pivotably supporting slides into said cavity, thereby causing said cutting diameter to increase; and wherein each of said means for cutting has a plurality of adjustment holes and said means for slidably supporting has a screw or pin that is insertable into one of said plurality of adjustment holes.

24. A mechanical broadhead comprising:

a plurality of blades, each of said blades having a forward end and a body;

first means for supporting, first means for supporting providing support for the forward end of each of said blades pivotably; and second means for supporting, second means for supporting providing support for the body of each of said blades laterally;

thereby providing two points of support for each of said blades;

wherein each body is provided with a plurality of adjustment holes and each body is fixed to said second means for supporting by a fastener.

* * * * *